US008091395B2

(12) United States Patent
Suzuki et al.

(10) Patent No.: US 8,091,395 B2
(45) Date of Patent: Jan. 10, 2012

(54) SYSTEM, METHOD, SOFTWARE ARRANGEMENT AND COMPUTER-ACCESSIBLE MEDIUM FOR PRESS-FORMING OF MATERIALS

(75) Inventors: Noriyuki Suzuki, Chiba-Ken (JP); Akihiro Uenishi, Chiba-Ken (JP); Yukihisa Kuriyama, Chiba-Ken (JP); Toshiyuki Niwa, Chiba-Ken (JP); Takuya Kuwayama, Chiba-Ken (JP)

(73) Assignees: Nippon Steel Corporation, Tokyo (JP); Arcelor France, St. Denis (FR)

( * ) Notice: Subject to any disclaimer, the term of this patent is extended or adjusted under 35 U.S.C. 154(b) by 0 days.

(21) Appl. No.: 12/979,203

(22) Filed: Dec. 27, 2010

(65) Prior Publication Data

US 2011/0094279 A1 Apr. 28, 2011

Related U.S. Application Data

(62) Division of application No. 11/575,059, filed as application No. PCT/JP2005/016527 on Sep. 8, 2005, now Pat. No. 7,886,564.

(30) Foreign Application Priority Data

Sep. 10, 2004 (JP) ..... 2004-264434

(51) Int. Cl.
*B21D 5/02* (2006.01)
*B21D 24/04* (2006.01)
*B30B 15/02* (2006.01)

(52) U.S. Cl. ..... 72/14.9; 72/15.1; 72/16.1; 72/17.2; 72/21.1; 72/31.01; 72/350; 72/351; 72/453.13; 700/104; 100/99

(58) Field of Classification Search ..... 72/14.9, 72/15.1, 17.2, 21.1, 31.01, 350, 351, 453, 72/13, 16.1; 700/104, 106; 100/99
See application file for complete search history.

(56) References Cited

U.S. PATENT DOCUMENTS 5,734,843 A 3/1998 Gephardt et al.
5,864,482 A 1/1999 Hazama et al.
7,257,460 B2 8/2007 Venugopal et al.
(Continued)

FOREIGN PATENT DOCUMENTS

CN 1114599 A 1/1996
(Continued)

OTHER PUBLICATIONS

Hayashi, Hisashi , "Material for Press-Forming and Material for Mold", *Partial Translation Table 3.2.11* Oct. 31, 2003 , p. 77.

(Continued)

*Primary Examiner* — David Jones
(74) *Attorney, Agent, or Firm* — Dorsey & Whitney LLP

(57) ABSTRACT

A system, method and software arrangement are provided for generating press-formed parts having a more consistent quality based on improved determination of processing conditions. For example, an apparatus can be configured to compare actual performance values of material properties provided by a material property database with standard values, and to adjust forming conditions such as a forming speed and a blank-holder pressure in accordance with the compared result. A control arrangement can be provided to control a press-forming device using the adjusted forming conditions. Accordingly, it may be possible to reduce occurrences of defects such as cracks and wrinkles when press-forming materials, and to obtain products having consistent quality and substantially identical shapes.

19 Claims, 7 Drawing Sheets

U.S. PATENT DOCUMENTS

| | | | | |
|---|---|---|---|---|
| 7,398,129 | B2 | 7/2008 | Ishii et al. | |
| 7,886,564 | B2 * | 2/2011 | Suzuki et al. | 72/14.9 |

FOREIGN PATENT DOCUMENTS

| | | |
|---|---|---|
| JP | 01-233019 | 9/1989 |
| JP | 05-285554 | 11/1993 |
| JP | 5285700 | 11/1993 |
| JP | 05285700 | 11/1993 |
| JP | 06246499 | 9/1994 |
| JP | 07265957 | 10/1995 |
| JP | 07266100 | 10/1995 |
| JP | 08300048 | 11/1996 |
| JP | 10128451 | 5/1998 |
| JP | 11-197990 | 7/1999 |
| JP | 2000-066340 | 3/2000 |
| JP | 3277366 | 2/2002 |
| JP | 3338373 | 10/2002 |
| JP | 2003011128 | 1/2003 |
| JP | 2003-036106 | 2/2003 |
| JP | 2003-311338 | 11/2003 |
| JP | 2004-249365 | 9/2004 |
| TW | 516077 | 1/2003 |
| TW | 583561 | 4/2004 |

OTHER PUBLICATIONS

Japanese Office Action dated Oct. 12, 2010 for JP 2004-264434.

Non-final office action for U.S. Appl. No. 11/575,059 dated Jun. 15, 2010.

Taiwanese Office Action dated Mar. 12, 2008 for Application No. 94131121.

Japanese Office action mailed Feb. 24, 2009 for Japanese No. 2004-264434.

Office action for Chinese application No. 200580030322.X dated Feb. 15, 2008.

Japanese Office Action mailed Jul. 26, 2011 for Japanese Application No. 2009-195645.

* cited by examiner

FIG. 4A

401

MATERIAL CHARACTERISTIC INQUIRY SCREEN

LOT NUMBER ○△□× ○△□×

TRANSMISSION

FIG. 4B

402

MATERIAL CHARACTERISTIC RECEIVE SCREEN

LOT NUMBER ○△□× ○△□×

| | |
|---|---|
| TENSILE STRENGTH | 620MPa |
| 0.2% PROOF STRESS | 390MPa |
| TOTAL ELONGATION | 24% |
| SHEET THICKNESS | 1.410mm |
| DATE OF MANUFACTURE | 2004/○○/△△ |

SYSTEM, METHOD, SOFTWARE ARRANGEMENT AND COMPUTER-ACCESSIBLE MEDIUM FOR PRESS-FORMING OF MATERIALS

CROSS-REFERENCE TO RELATED APPLICATIONS

This application is a divisional application of U.S. patent application Ser. No. 11/575,059, filed on Mar. 9, 2007, now U.S. Pat. No. 7,886,564 which is the national stage application of PCT Application No. PCT/JP2005/016527 which was filed on Sep. 8, 2005 and published on Mar. 16, 2006 as International Publication No. WO 2006/028175, the entire disclosures of both applications are incorporated herein by reference. This application claims priority from the International Application pursuant to 35 U.S.C. §365, and from Japanese Patent Application No. 2004-264434, filed Sep. 10, 2004, under 35 U.S.C. §119, the entire disclosures of which are incorporated herein by reference.

FIELD OF THE INVENTION

The present invention relates to a system, method, computer software arrangement and computer-accessible medium for press-forming of a material.

BACKGROUND INFORMATION

Forming processes can be performed using various forming conditions such as, for example, a mold shape, a lubricating condition, a forming speed, a blank-holder force, a temperature of a mold and a material to be press-formed. Conventionally, such conditions may be defined in advance for a particular material based on, e.g., a prior similar procedure, an experimental production, a process simulation using a finite element method, or the like. This approach can be used for metallic materials undergoing, e.g., a deep-drawing process, a bending process, a cutting process, and the like, using a press-forming device.

However, various metallic materials which may be used as, e.g., a plate material, a pipe material, a bar material, a wire material, a granular material, and so on, can be obtained from a raw material and/or a scrap material passing through several processes such as, e.g., melting, smelting, molding, rolling, heat treatment and/or a secondary pressing process. Consequently, a certain degree of variation may exist in mechanical properties of a formed product arising from variations in process conditions resulting from, e.g., a variation of chemical components, a nonuniformity of temperature, and so on. Accordingly, undesirable forming results may occur because formability may vary in different portions of the material or throughout a production lot, even if adequate forming conditions are defined in advance as described above. Quality control in a material manufacturing process can be performed more rigorously to help avoid such undesirable forming behavior. However, excessive quality control requirements may cause an increase in material cost, and thus may not be preferable.

Poor forming behavior may also occur because of environmental changes during a press-forming process, for example, a temperature change of a mold in a continuous press-forming process, an abrasion of the mold, changes of temperature and humidity of an atmosphere, etc., even if the characteristic mechanical properties of the material itself remain uniform.

For example, a technique for performing a forming process by controlling forming conditions in accordance with conditions of a material and as mold is described in Japanese Patent Application No. Hei 7-266100. A relationship can be determined in advance between a shape of a press material, mechanical and chemical properties of the press material, lamination characteristics such as a plating, and physical characteristics of the material surface, such as oil quantity present, and/or a blank-holder load capable of obtaining a predetermined press quality. An adequate blank-holder load can be determined based on a relationship between a predetermined physical quantity of the press material and the press-forming conditions capable of obtaining the predetermined press quality. Air pressure of an air cylinder can thus be controlled so that a press-forming process can be performed with an adequate blank-holder load.

For example, techniques in which press conditions are adjusted based on machine information and mold information unique to a press-forming device are described, e.g., in Japanese Patent Application Nos. Hei 5-285700 and Hei 6-246499.

Further, techniques in which a material to be processed can be adjusted to a predetermined bending angle in a bending press-forming process using a press brake are described, e.g. in Japanese Patent Application Nos. Hei 7-265957, Hei 10-128451, and Hei 8-30004.

Material characteristics and environments can vary temporarily or momentarily when a material is press-formed. However, it can be extremely difficult to predict the above-described variation of material characteristics and environmental changes when the material to be processed is press-formed beforehand, even if the blank-holder load is controlled based on the material characteristics, information unique to the press-process device, and/or the mold information, as described in Japanese Patent Application Nos. Hei 7-266100, Hei 5-285700, and Hei 6-246499 described above. Further, it can be difficult to measure and characterize a complicated three-dimensional shape such as a drawing press-process and a cutting press-process on the moment. Additionally, the material to be press-processed during the press-forming process can be engaged by the mold, and therefore it may be very difficult to measure an accurate shape, even if the thrilling conditions are adjusted in accordance with a deformed state of the material during press-forming as described, e.g. in the above-cited Japanese Patent Application No. Hei 7-265957, Japanese Patent Application No. Hei 10-128451, and Japanese Patent Application No. Hei 8-300048.

Thus, there may be a need for improved systems, methods, software arrangements and computer-accessible media for press-forming of materials which overcome the above-mentioned deficiencies.

SUMMARY OF EXEMPLARY EMBODIMENTS OF THE INVENTION

One object of the present invention is to provide an improved press-forming process for materials.

In a press-forming system according to exemplary embodiments of the present invention, a processing device such as, e.g., a computer, can be configured to control a press machine and can be connected to a network. The computer can receive detailed material characteristics of metallic materials on demand from a server-side, computer via the network, where such characteristics may be difficult to obtain using conventional techniques. The computer can also receive information relating to environmental changes and process shapes associated with the press machine from various measuring devices (e.g., sensors) provided at the press machine. Such information may also be difficult to obtain in a timely manner using conventional techniques. In this manner, a system can be provided in which press-forming conditions can be calculated based on variations of the material characteristics and changes in the environment of the press machine, the press machine can be controlled based on the calculated press forming conditions, and improved press-formed products can be obtained.

A press forming system in accordance with exemplary embodiments of the present invention can be provided which has a press-forming apparatus configured to press-form a material, a user-side computer configured to accept user input and to control the press-forming apparatus, a material property database which may store material identification numbers for identifying the material being press-formed by the press-forming apparatus, where certain material property data in the database can be associated with the material identified by the material identification number, and a computer server device connected to the user-side computer via a network. The user-side computer can include a data input arrangement for providing a material identification number, and a material identification number transmission arrangement configured to transmit the material identification number. The server side computer can include a receiving arrangement configured to receive the material identification number transmitted by the material identification number transmission arrangement, and a material property data transmission arrangement configured to transmit the material property data stored in the material property database which corresponds to the received material identification number. The user-side computer can further include a material property data receiving arrangement configured to receive the material property data. The press-forming apparatus can include a punch, a die and a blank-holder, and can further include a process condition control arrangement configured to press-form a material using one or more process conditions based at least in part on the material property data received by the material property data receiving arrangement.

A press-forming method can be provided in accordance with exemplary embodiments of the present invention which can include: inputting a material identification number, which can identify a material to be press-formed, using a user-side computer; transmitting the material identification number to a server-side computer; receiving the material identification number using the server-side computer via a network; transmitting material property data stored in a material property database which corresponds to the received material identification number; receiving the material property data using the user-side computer; and press-forming the material using at least one process condition based on the received material property data.

A software arrangement and a computer-accessible medium in accordance with exemplary embodiments of the present invention can be provided which includes, e.g.: instructions which, when executed, can configure a processing arrangement associated with a user-side computer to receive a material identification number identifying a material to be press-formed; instructions which, when executed, can configure a processing arrangement to transmit the material identification number from the user-side computer to a server-side computer; instructions which, when executed, can configure a processing; arrangement associated with a server-side computer to receive the material identification number; instructions which, when executed, can configure a processing arrangement associated with a server-side computer to transmit material property data is a network, where the material property data may be stored in a material property database and can correspond to the material identification number received via a network; instructions which, when executed, can configure a processing arrangement associated with a server-side computer to transmit the material property data to the user-side computer; and instructions which, when executed, can configure a processing arrangement to control a press-forming apparatus by varying at least one process condition based on the received material property data.

These and other objects, features and advantages of the present invention will become apparent upon reading the following detailed description of embodiments of the invention, when taken in conjunction with the appended claims.

BRIEF DESCRIPTION OF THE DRAWINGS

Further objects, features and advantages of the invention will become apparent from the following detailed description taken in conjunction with the accompanying figures showing illustrative embodiments, results and/or features of the exemplary embodiments of the present invention, in which:

FIG. 4A is a diagram of an exemplary material property inquiry screen in accordance with exemplary embodiments of the present invention;

FIG. 4B is a diagram of an exemplary material property receiving screen in accordance with exemplary embodiments of the present invention;

Figure 1:
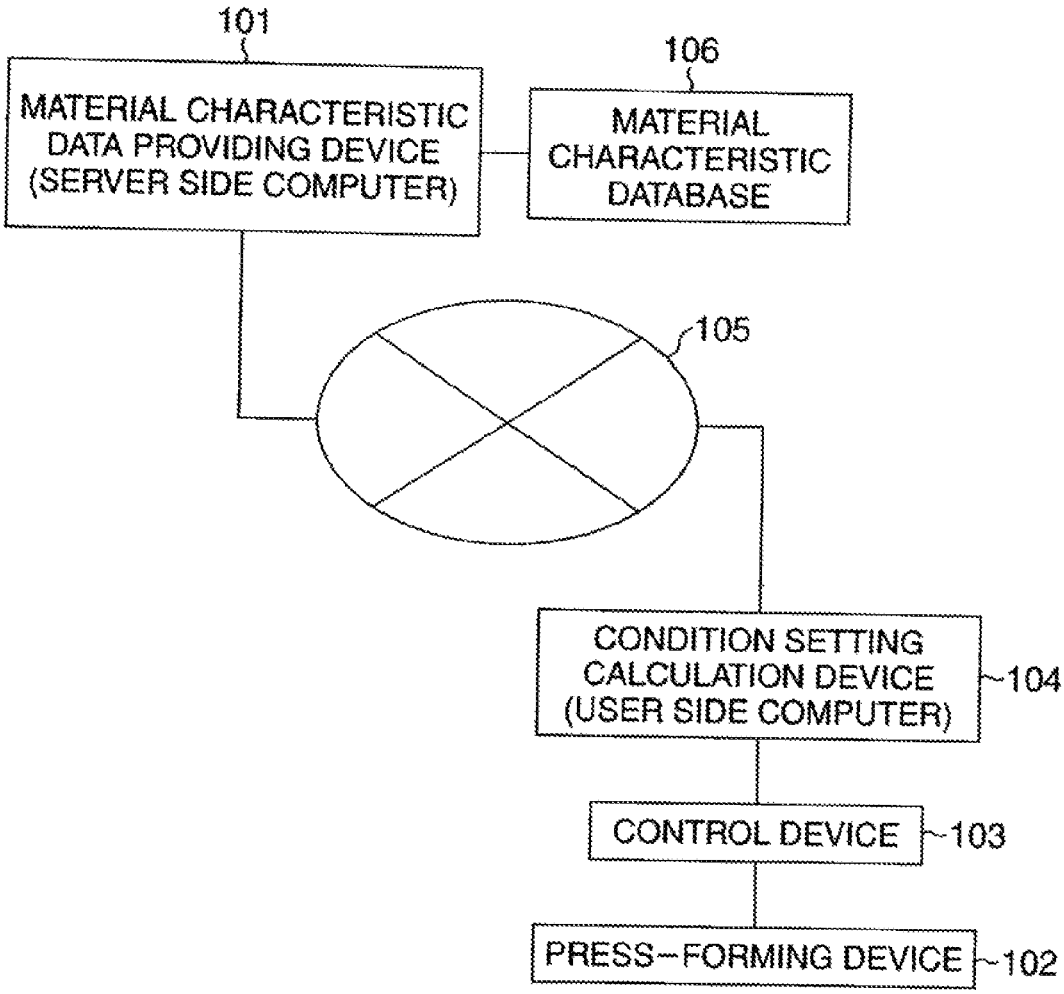
FIG. 1 is a schematic diagram of an exemplary configuration of a press forming system in accordance with an exemplary embodiment of the present invention.

Throughout the figures, the same reference numerals and characters, unless otherwise stated, are used to denote like features, elements, components or portions of the illustrated embodiments. Moreover, while the present invention will now be described in detail with reference to the figures, it is done so in connection with the illustrative embodiments.

DETAILED DESCRIPTION OF EXEMPLARY EMBODIMENTS OF THE INVENTION

FIG. 1 shows an exemplary schematic configuration of a press-forming system in accordance with exemplary embodiments of the present invention. In FIG. 1, the press-forming system has a material property data providing device (e.g., a server-side computer) 101, a press-forming device 102, a control device 103, a condition setting calculation device (e.g., a user-side computer) 104, a network arrangement 105, and a material property database 106. As shown in FIG. 1, the material property data providing device 101 and the condition setting calculation device 104 can be configured to communicate with each other via the network 105.

The material property data providing device 101 can be configured to provide material property data, representing characteristics of a material to be press-formed by the press-forming device 102, to the condition-setting calculation device 104 based on a request from the condition-setting calculation device 104. The material property data providing device 101 can be associated with, e.g., a personal computer.

For example, a cold-rolled high tensile strength steel sheet with a tensile strength of 590 [MPa], a sheet thickness of 1.4 [mm], and a sheet surface size of 1000 [mm]×500 [mm] can be provided as an exemplary material to be processed. Such cold-rolled high tensile strength steel sheets can be provided in 100-sheet packages to the press-forming system. Production lot numbers can be associated with such packages. Material property data can be provided for the cold rolled high tensile strength steel sheet which can include, for example, one or more of sheet thickness, a yield stress, a tensile strength, 0.2% proof stress, an elongation, an n-value, an r-value, a relational expression between a stress and a strain, a hardness, a temperature, a surface roughness, a friction coefficient, a lubricant film thickness, and so on.

Figure 2:
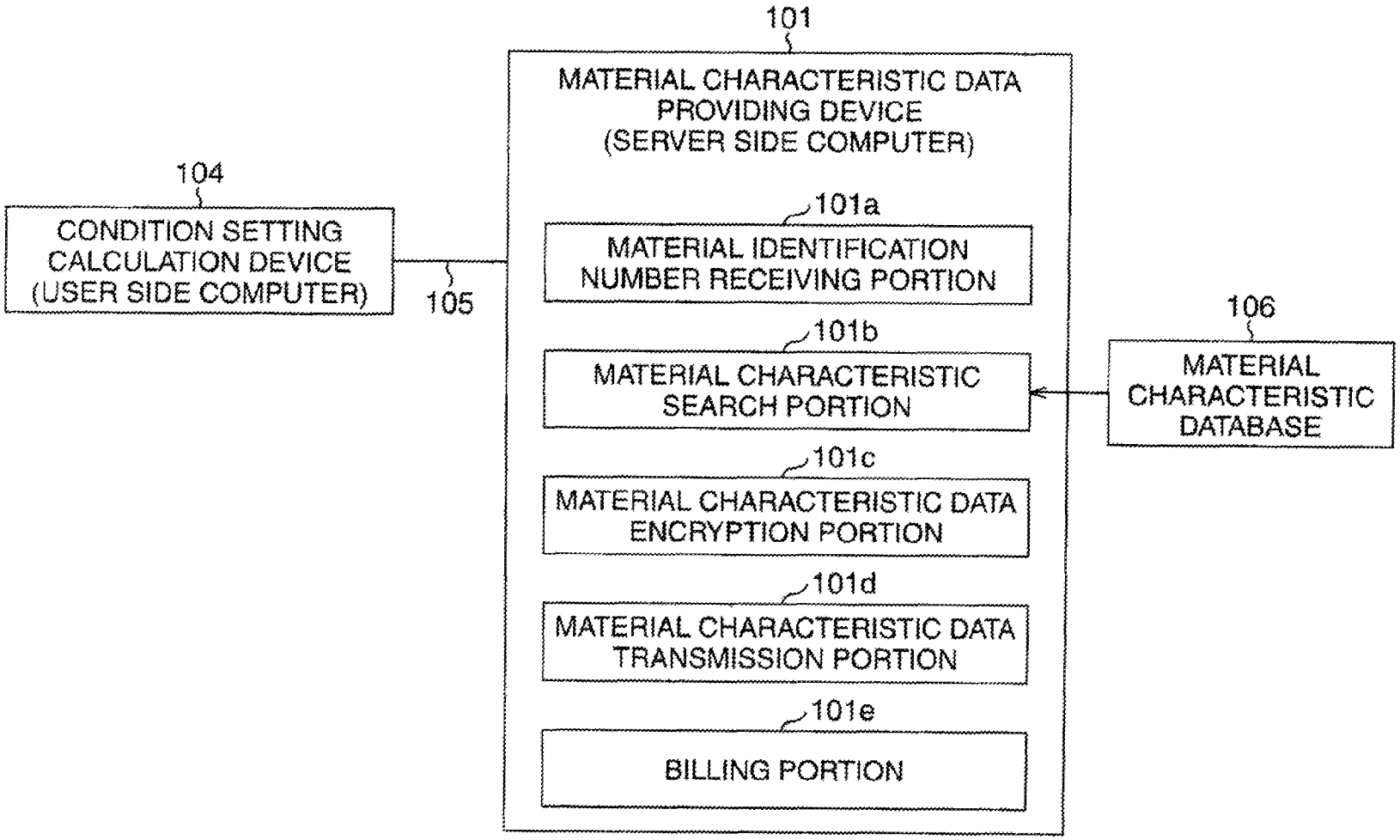
FIG. 2 is a block diagram showing a portion of an apparatus configured to provide material property data in accordance with exemplary embodiments of the present invention.

FIG. 2 is a block diagram showing a portion of an exemplary functional configuration of the material property data providing device 101. In FIG. 2, the material property data providing device 101 can have a material identification number receiving portion 101*a*, a material property search portion 101*b*, a material property data encryption portion 101*c*, a material property data transmission portion 101*d*, and a billing portion 101*e*.

The material identification number receiving portion 101*a* can be configured to receive a material identification number transmitted from the condition-setting calculation device 104, as described herein below. In certain exemplary embodiments of the present invention, the material identification number can correspond to a production lot number supplied with the package of sheets.

The material property search portion 101*b* can search the material property data contained in the material property database 106 which corresponds to the material identification number received by the material identification number receiving portion 101*a*. As stated above, the material property data can be identified in the material property database 106 by a material identification number.

The material property data encryption portion 101*c* can encrypt the material property data searched by the material property search portion 101*b*. The material property data transmission portion 101*d* can transmit the encrypted material property data to the condition-setting calculation device 104.

The billing portion 101*e* can update, for example, a transmission history file (which can include, e.g., a client name, connection date and time, transmission data amount, and so on) when the material property data is transmitted to the user-side condition-setting calculation device 104. It can also be configured to aggregate the transmission history file periodically, and may generate bills based on a total communication quantity.

In FIG. 1, the condition-setting calculation device 104 can be configured to determine appropriate forming conditions (e.g., process conditions) of the material to be processed based on the material property data transmitted from the material property data providing device 101 as described above. The condition-setting calculation device 104 can be associated with, for example, a personal computer.

The control device 103 can be configured to control operations of the press-forming device 102 and/or to monitor operations of the press-forming device 102 in accordance with the forming conditions provided by the condition-setting calculation device 104. The press-forming device 102 can press-form the material based on control provided by the control device 103. As described above, a press-forming apparatus can include both a press-forming device 102 and a control device 103 in accordance with certain exemplary embodiments of the present invention.

Figure 3:
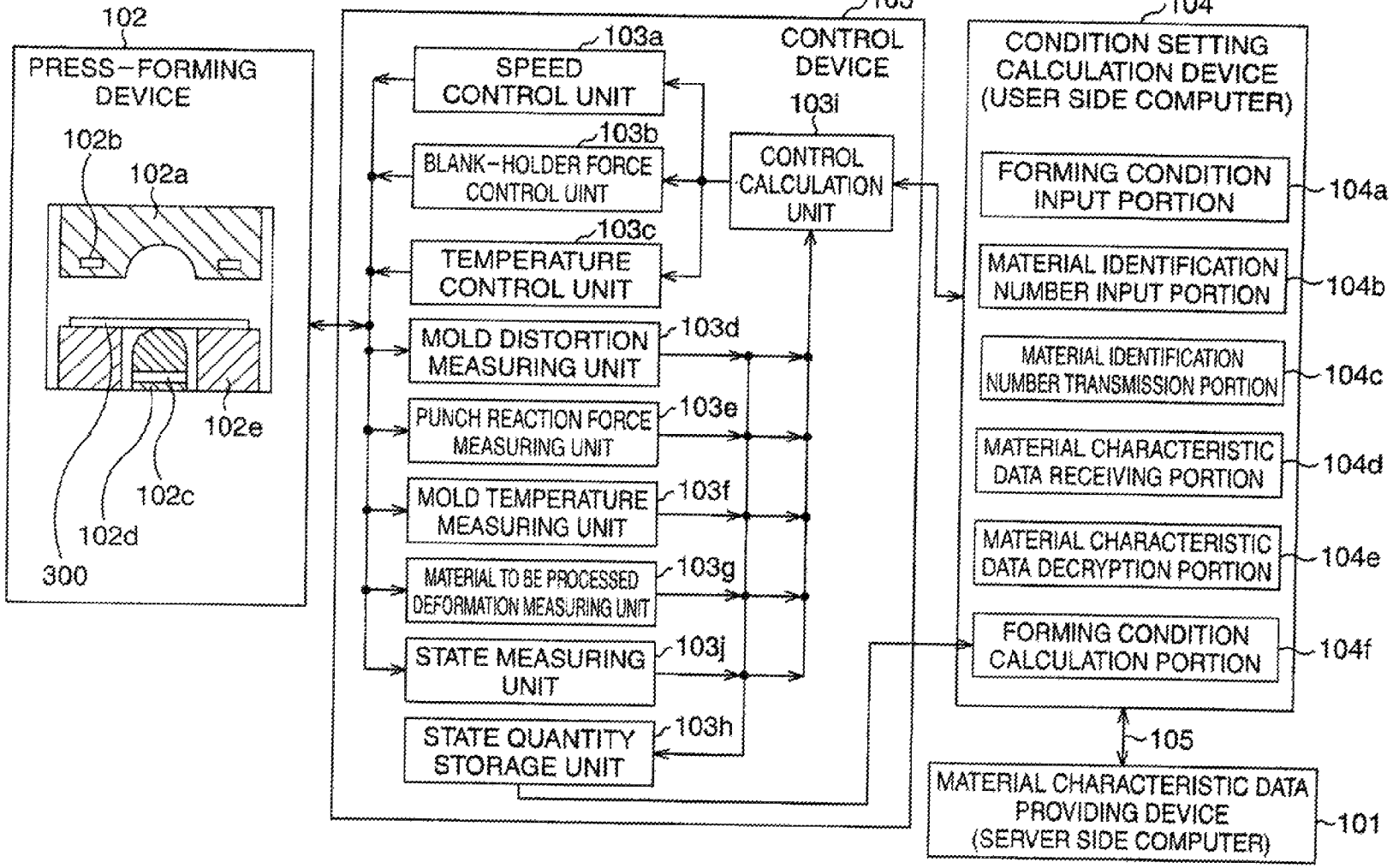
FIG. 3 is a schematic diagram of portions of a press-forming apparatus, a control apparatus, and a condition-setting calculation apparatus in accordance with exemplary embodiments of the present invention.

FIG. 3 shows a portion of an exemplary system configuration which includes the press-forming device 102, the control device 103, and the condition-setting calculation device 104. As shown in FIG. 3, the press-forming device 102 can include a die 102*a*, a strain sensor 102*b*, a load cell 102*c*, a punch 102*d*, and a blank-holder 102*e*.

The press-firming device 102 shown in FIG. 3 can be configured, e.g., such that, a material to be processed 300 is press-formed along a forming surface of a punch 102*d* by driving a die 102*a* in a longitudinal direction. A strain sensor 102*b* can be configured to detect a distortion of a mold which may include the 102*a*, the punch 102*d*, and so on. The load cell 102*c* can be configured to detect a punch reaction force and/or other forces which may be present during a press-forming process. The blank-holder 102*e* can be provided to prevent an occurrence of wrinkles when the material to be processed 300 is press-formed.

Additional components of the press-forming device 102 can be provided such as, e.g., an air cylinder, a hydraulic cylinder, a heater, and/or a hydraulic controller, even though such additional components are not shown in FIG. 3.

The control device 103 can include a speed control device 103*a*, a blank-holder force control device 103*b*, a temperature control device 103*c*, a mold distortion measuring unit 103*d*, a punch reaction force measuring unit 103*e*, a mold temperature measuring unit 103*f*, a material deformation measuring unit 103*g*, a state quantity storage unit 103*h*, a control calculation unit 103*i*, and/or a state measuring unit 103*j*.

The speed control device 103*a* can be provided to control a forming speed defined by, e.g., a drive speed of the die 102*a*. The blank-holder force control device 103*h* can be provided to control a blank-holder pressure a blank-holder force) provided by the blank holder 102*e* to the material to be processed 300. The temperature control device 103*c* can be provided to control the temperature of the mold.

The mold distortion measuring unit 103*d* can be provided to measure a distortion of the mold by reading a detected value of the strain sensor 102*b*. The punch reaction force measuring unit 103*e* can be provided to measure the punch reaction force by reading a detected value of the load cell 102*c*. The mold temperature measuring unit 103*f* can be provided to measure the temperature of the mold and the material to be processed 300 by reading a detected value of a temperature sensor (e.g., a thermocouple) attached to the 102*a*, the punch 102*d*, and so on.

The material deformation measuring unit 103*g* can be provided to measure a degree of deformation of the material to be processed 300. The state measuring unit 103*j* can be provided to measure the material to be processed 300 before a press-forming process to obtain material property measurement data. Examples of material property measurement data which may be measured can include, e.g., data based on a hardness, a surface roughness, a friction coefficient, and so on.

The state quantity storage unit 103*h* can be provided to store to history of state quantity of the press-forming device 102 which may be measured by the mold distortion measuring unit 103*d*, the punch reaction force measuring unit 103*e*, the mold temperature measuring unit 103*f*, the material to be processed deformation measuring unit 103*g*, and/or the state measuring unit 103*j* as described above. The control device 103 can thus be used to provide control over certain process conditions, as described above.

The condition-setting calculation device 104 may have a forming condition input portion 104*a*, a material identification number input portion 104*b*, a material identification number transmission portion 104*c*, a material property data receiving portion 104*d*, a material property data decryption portion 104*e*, and a forming condition calculation portion 104*f*.

The forming condition input portion 104*a* can be provided to receive and store basic forming conditions based on an operation of an operation portion provided by a user. In certain exemplary embodiments of the present invention, the forming condition input portion 104*a* can receive information such as a blank-holder force, a forming speed, a mold temperature, and so on, as the basic forming, conditions.

The material identification number input portion 104*b* can be provided to receive the input of a material identification number based on a user's operation for a material characteristic inquiry screen 401 as shown in FIG. 4A.

The material identification number transmission portion 104*c* can be provided to transmit the material identification number (production lot number) to the material property data providing device 101 when e.g., a transmission button is pressed by the user after the material identification number (e.g., a production lot number) is provided to the material characteristic inquiry screen 401 shown in FIG. 4A.

The material property data receiving portion 104*d* can be provided to receive encrypted material property data transmitted from the material property data providing device 101 in response to the material identification number transmitted by the material identification number transmission portion 104*c*.

The material property data decryption portion 104*e* can be used to decrypt the encrypted material property data for calculating the forming conditions.

The condition-setting calculation device 104 can include a material property receive screen 402, as shown in FIG. 4B, which may be displayed on a monitor after the material property data is received at the material property data receiving portion 104*d* and decrypted. However, the decrypted material property data may be directly used for the calculation of the forming conditions without being displayed on the monitor, to make the material property data invisible to the user. In this manner, unauthorized copying and/or use of the material property data can be prevented.

The forming condition calculation portion 104*f* can be provided to calculate or determine forming conditions in the press-forming device 102 by using the material property data received by the material property data receiving portion 104*d*, the state quantity of the press-forming device 102 stored in the state quantity storage unit 103*h*, and so on.

Operation of an exemplary press-forming system in accordance with exemplary embodiments of the present invention may be described with reference to the flow charts shown in FIG. 5 and FIG. 6.

The press-forming system can wait until the material to be processed 300 is provided to the press-forming device 102 (step S1). When the material to be processed 300 is provided to the press-forming device 102, the material identification number input portion 104*b* of the condition-setting calculation device 104 can determine whether or not the material identification number has been provided and the transmission button has been pressed, based on the user's operation of the material property inquiry screen 401 shown in FIG. 4A (step S2).

When the material identification number is provided and the transmission button is pressed as a result of the above determination, the material identification number transmission portion 104*c* of the condition-setting calculation device 104 transmits the material identification number to the material property data providing device 101 (step S3).

Next, the material identification number receiving portion 101*a* of the material property data providing device 101 determines whether the material identification number transmitted at the step S3 is received or not (step S4).

When the material identification number is received, the material property search portion 101*b* of the material property data providing device 101 obtains the material property data corresponding to the material identification number from the material property database 106 (step S5).

Next, the material property data encryption portion 101*c* of the material property data providing device 101 encrypts the material property data (step S6).

The material property data transmission portion 101*d* of the material property data providing device 101 then transmits the encrypted material property data to the condition setting calculation device 104 (step S7).

Next, the material property data receiving portion 104*d* of the condition setting calculation device 104 can determine whether or not the transmitted encrypted material property data is received (step S8).

When the material property data is received, the material property data decryption portion 104*e* of the condition setting calculation device 104 may decrypt the material property data (step S9). The material property data receiving portion 104*d* can when record the decrypted material property data (step S10).

Next, the forming condition input portion 104*a* of the condition-setting calculation device 104 may determine whether or not the basic forming conditions have been provided based on the user's operation (step S11). When the basic forming conditions are provided, the forming condition input, portion 104*a* can store the basic forming conditions (step S12).

The state measuring unit 103*j* of the control device 103 may then measure the hardness, the surface roughness, the friction coefficient, and so on of the material to be processed 300, and can store the material property measurement data based on the measured hardness, surface roughness, and friction coefficient (step S13.

Next, the forming condition calculation portion 104*f* of the condition-setting calculation device 104 can read the history of the state quantity of the press-forming device 102 stored in the state quantity storage unit 103*h* of the control device 103 (step S14). At this time, the forming condition calculation portion 104*f* can also read the material property measurement data stored in step S13.

Next, the forming condition calculation portion 104*f* corrects the forming conditions of the press-forming device 102 based on the material property data stored in step S10, the basic forming conditions stored in step S12, and the history of the state quantity of the press-forming device 102 and the material characteristic measurement data read at step S14 (step S13).

For example, an initial value "C0(i)" of a forming condition can be corrected by using the following relationship:

$$C'0(i)=C0(i)\times(1+\Sigma(T1(i,j)\times P(j)/P0(j)/-1))); \; i=1 \text{ to } L, \; j=1 \text{ to } M. \quad \text{(EXPRESSION 1)}$$

In this equation, "C0'(i)" can be a forming condition determined based on the correction. "T1(i, j)" can be an influence function matrix representing a relationship between a deviation of a material property of the material to be processed 300 relative to a standard value, and a correction amount of the forming condition. "P(j)" can be an actual performance value associated with each material property. "P0(j)" can be a standard or reference value of each material property. "M" can represent the number of material properties considered, "L" can refer to the number of setting values of the forming condition.

Here, the initial value "C0(i)" of the forming conditions may be constant or it may change during the forming process. When it is changed during the forming process, for example, a setting value for a stroke amount of the punch 102*d* may be provided.

Components of the influence function matrix "T1(i, j)" can be obtained from a change of an optimal forming condition (e.g., a sensitivity analysis) relative to changes of various material properties, by using a forming simulation based on, e.g., a finite element method. Such components may also be determined statistically based on, e.g., a relationship between a variation of the material properties and the forming conditions and certain measurements of product quality (e.g., cracks, wrinkles, springback, surface distortion, and so on) obtained from an actual mass production press. Alternatively, an actual measured value of the product quality can be provided to the press-forming device 102 as instruction data and, for example, it may be created and updated by using a learning function such as one provided by a neural network. Techniques for relating material properties and forming conditions are not limited to those described above, and arbitrary settings may also be used.

Figure 6:
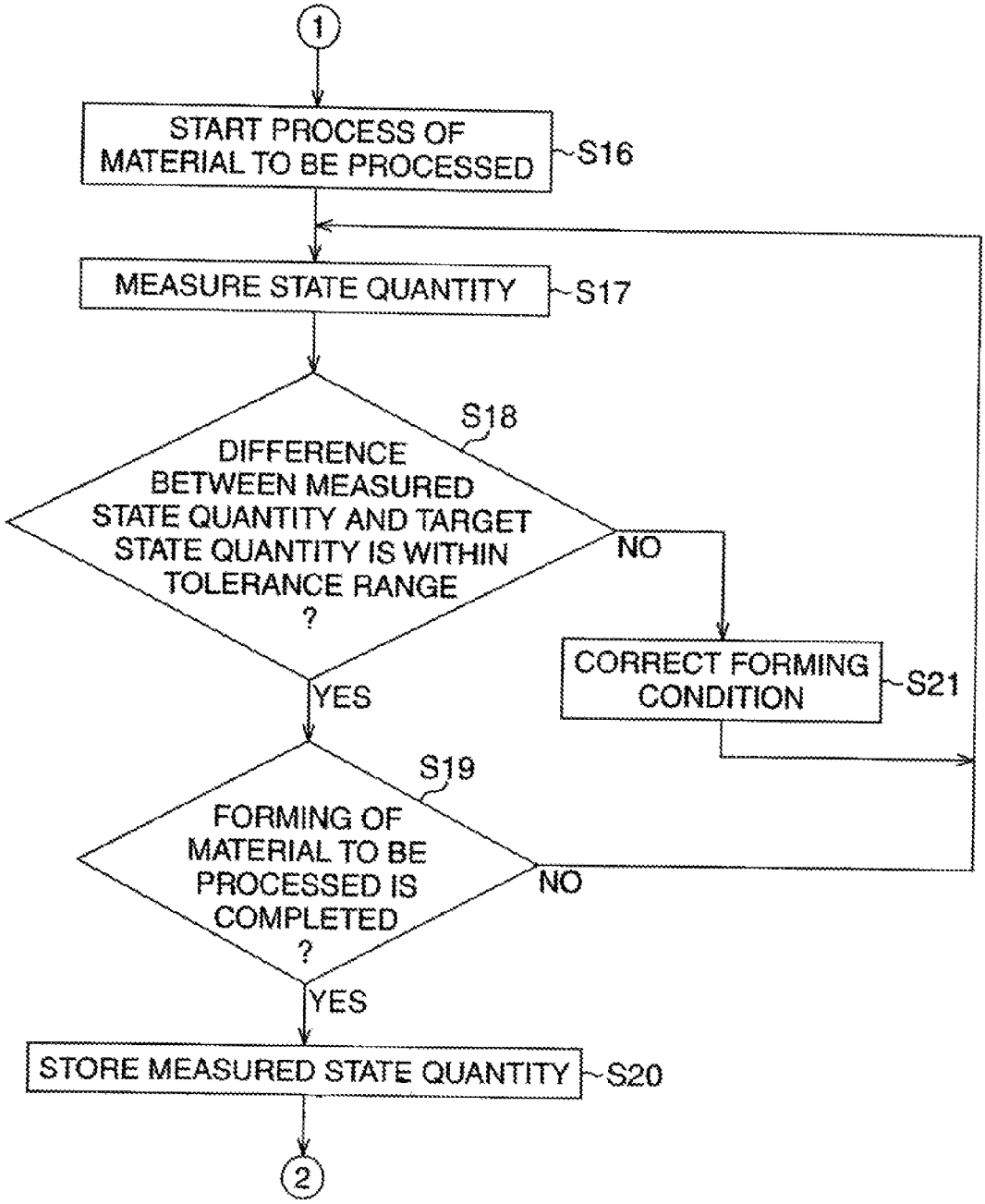
FIG. 6 is a flow chart illustrating certain exemplary operations of the press forming system which may occur subsequent to the operations shown FIG. 5.

Referring to FIG. 6, the control calculation unit 103*i* may read the forming conditions of the press-forming device 102 which were corrected at step S15, and outputs a control command based on the read forming conditions to the speed control device 103*a*, the blank-holder force control device 103*b*, and the temperature control device 103*c* (step S16). The speed control device 103*a*, the blank-holder force control device 103*b*, and the temperature control device 103*c* can then control the press-forming device 102 based on this control command. Accordingly, press-forming of the material to be processed 300 is started.

Next, the mold distortion measuring unit 103*d*, the punch reaction force measuring unit 103*e*, the mold temperature measuring unit 103*f*, and/or the material to be processed deformation measuring unit 103*g* may measure the state quantity of the press-forming device 102 during the press-forming process (step S17).

The forming condition calculation portion 104*e* can then determine whether a difference of the state quantity measured in step S17 and a target state quantity defined in advance is within a tolerance range or not (step S18). When the difference is within the tolerance range as a result of this determination, the control calculation unit 103*i* then determines whether the press-forming process is completed or not, for example, based on the measured result of the material to be processed deformation measuring unit 103*g* (step S19).

When the press-forming of the material can be completed as a result of this determination, the state quantity measured in step S17 may be stored or recorded in the state quantity storage unit 103*h* (step S20). The process then goes back to step S1, and can wait for an acceptance of the next material to be processed 300. If the press-forming process is not completed, the process goes back to step S17, and the state quantity is measured twain.

When it is determined that the difference between the state quantity measured in step S17 and the pre-defined target state quantity is not within the tolerance range in step S18, the forming condition calculation portion 104*f* can correct the forming condition (step S21). The process then goes back to step S17, and the state quantity is measured again.

The forming condition "C0'(i)" provided in Expression (1) above can be corrected by using the following relationship:

$$C(i)=C0'(i)\times(1+\Sigma(T2(i,k)\times S(k)/S0(k)-1))); \; i=1 \text{ to } L, \; k=1 \text{ to } N. \qquad \text{(Expression 2)}$$

In this expression, "C(i)" can represent a correction value for the forming condition. "T2(i, k)" can be an influence function matrix representing a relationship between a deviation of the measured various state quantities relative to a standard value and a correction amount of a forming condition. "S(k)" an represent the state quantity measured in step S17, "S0(k)" can be a standard or reference value of the state quantity, "N" can represent the number of the state quantities considered.

Components of the influence function matrix "T2(i, k)" can be obtained from the change of the optimal forming condition (e.g., a sensitivity analysis) relative to the changes of various material characteristics by using a forming simulation employing, e.g., a finite element method, similar to the manner M which components of the influence function matrix "T1(i, j)" can be determined. The components can also be determined statistically based on a relationship between a variation of the material properties and the forming condition and a measure of product quality (e.g., cracks, wrinkles, springback, surface distortion, and so on) produced in the actual mass production press. Alternatively, an actual measured value of the product quality can be provided to the press-forming device 102 as instruction data and, for example, it can be created and updated by using a learning function such as that provided by a neural network. Determination and formulation of a state quantity are not limited to the techniques described above, and arbitrary settings may also be used.

As described above, the actual performance value and the standard value of a material property may be compared, forming conditions such as the forming speed and the blank-holder pressure can be corrected based on this comparison, and the press-forming process may then be started using the corrected forming conditions. Therefore, it may be possible to reduce the occurrences of cracks and wrinkles, and to suppress influences of variable factors difficult to predict such as the variation of the material properties and/or environmental changes that may occur when the material is press-formed. Accordingly, it may be possible to determine improved forming conditions, and to obtain desirable formed products.

Figure 5:
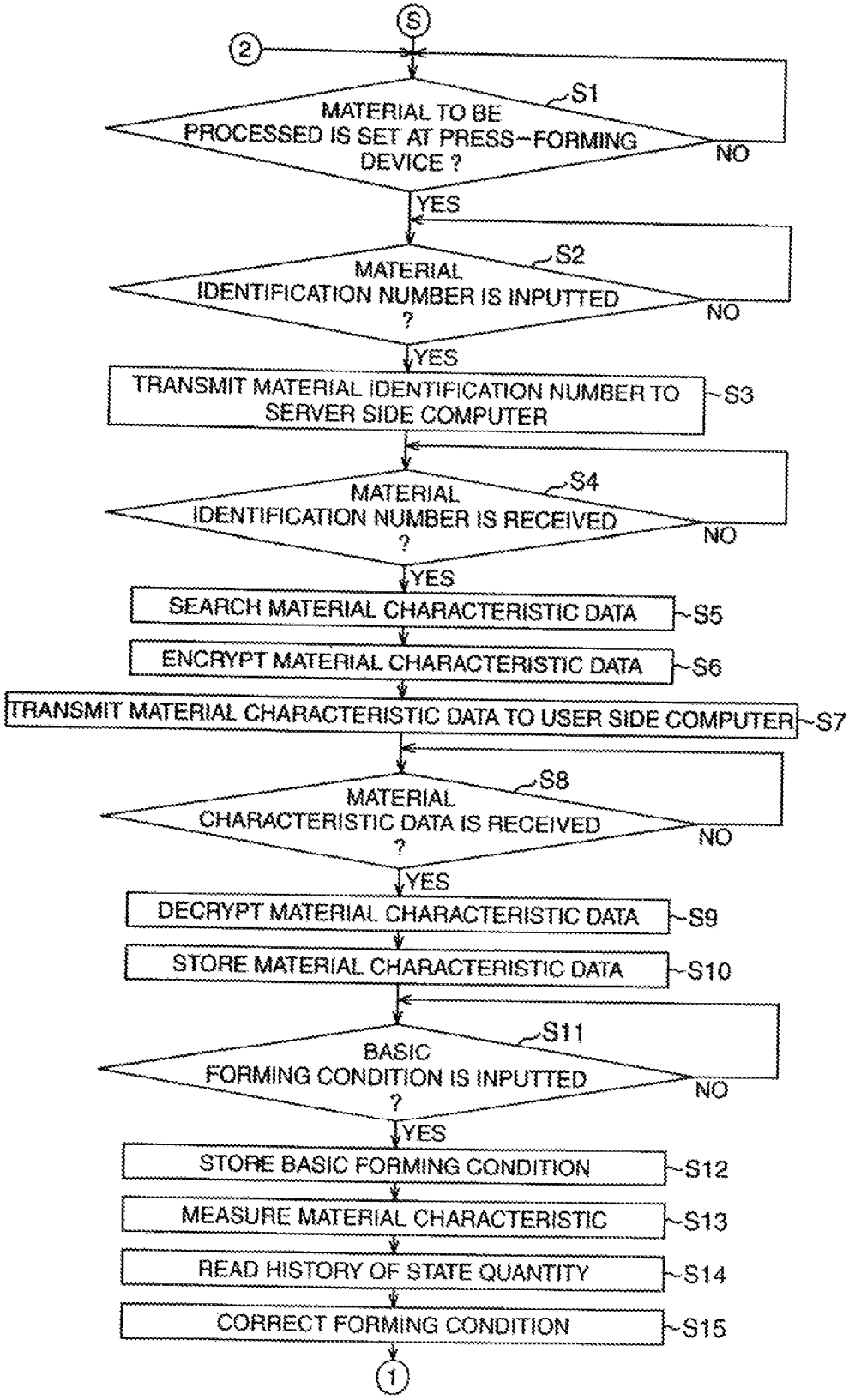
FIG. 5 is a flow chart of an exemplary press-forming system in accordance with exemplary embodiments of the present invention.

The flow charts shown in FIG. 5 and FIG. 6 correspond to an exemplary process in which the forming conditions are corrected each time a new piece of material is press-formed. It is also possible to correct the forming conditions for an entire production lot. For example, the process flow can be transferred to step S16 (rather than back to step S1) after step S20 is completed in the now chart in FIG. 6.

Further, the material identification number (e.g., production lot number) can be provided using a keyboard or a mouse provided in connection with the condition setting calculation device 104, but the material identification number may not necessarily be provided as described above. For example, a barcode storing information relating to the production lot number can be attached to the material to be processed 300. The barcode can be read by a barcode reader, the production lot number of the material to be processed 300 can be determined based on the barcode information, and the determined production lot number can be transmitted to the material property data providing device 101.

The production lot number may also be stored, e.g., in an IC tag, a disk recording medium such as, e.g., a flexible disk, a magnetic disk or an optical disk, etc., and the number may be transmitted from such media to the material property data providing device 101.

Example 1

In one exemplary embodiment of the present invention, a cold-rolled high tensile strength steel sheet with a tensile strength of 590 [MPa], a sheet thickness of 1.4 [mm], size of a sheet surface of 1000 [mm]×500 [mm] can be provided as a material to be processed.

The condition setting calculation device 104 may receive material property data such as actual performance values of the tensile strength, 0.2% proof stress, a total elongation, and the sheet thickness from the material property data providing device 101.

Next, initial values of the forming speed and the blank-holder pressure can be corrected for each production lot by using Expression (1) above using the actual performance values of the material properties before the press-forming process is performed. For example, the standard value "P0(j)" of the material properties can be provided by Expression (3) below, the actual performance value "P(j)" of the material properties can be provided by Expression (4) below, the standard value "C0(i)" of the forming conditions can be provided by Expression (5) below, and the influence function matrix "T1(i, j)" can be obtained from Expression (6) below. These values can each substituted into Expression (1), and a correction value "C0'(i)" of the forming conditions can be obtained as shown in Expression 7 below.

[Formula 1]

$$P0(j) = \begin{Bmatrix} \text{TENSILE STRENGTH [MPa]} \\ \text{0.2\% PROOF STRESS [MPa]} \\ \text{TOTAL ELONGATION [\%]} \\ \text{SHEET THICKNESS [mm]} \end{Bmatrix} = \begin{Bmatrix} 604.8 \\ 399.8 \\ 23.6 \\ 1.4 \end{Bmatrix} \quad \text{(EXPRESSION 3)}$$

NOTE THAT $j = 1$ to 4

$$P(j) = \begin{Bmatrix} 620 \\ 390 \\ 24 \\ 1.41 \end{Bmatrix} \quad \text{(EXPRESSION 4)}$$

$$C0(i) = \begin{Bmatrix} \text{FORMING SPEED [mm/sec]} \\ \text{BLANK-HOLDER PRESSURE [Ton]} \end{Bmatrix} = \begin{Bmatrix} 50.0 \\ 150.0 \end{Bmatrix} \quad \text{(EXPRESSION 5)}$$

NOTE THAT $i = 1$ to 2

-continued $$T1(i, j) = \begin{bmatrix} -0.5 & -0.5 & 0.5 & 0.5 \\ 0.5 & 0.5 & 0.5 & 0.5 \end{bmatrix} \quad \text{(EXPRESSION 6)}$$

$$C0'(i) = \begin{Bmatrix} \text{FORMING SPEED [mm/sec]} \\ \text{BLANK-HOLDER PRESSURE [Ton]} \end{Bmatrix} = \begin{Bmatrix} 50.6 \\ 151.9 \end{Bmatrix} \quad \text{(EXPRESSION 7)}$$

Next, a test press can be performed, where the punch reaction force measuring unit 103*e* and the mold distortion measuring unit 103*d* can pleasure the punch reaction force and the mold distortion during the forming, respectively. After it has been confirmed that the press formed product obtained by performing the test press is not defective and has no cracks, wrinkles, or the like, the forming condition calculation portion 104*f* of the condition-setting calculation device 104 can provide a forming speed and a blank-holder pressure based on Expression 7 above. A measured maximum value of the punch reaction force and a maximum value of the mold distortion can be used as standard values of the state quantity. In the example shown above in Expression 3-Expression 7, the forming condition calculation portion 1041 can sets a standard value "S0(k)" of the state quantity shown below:

[Formula 2]

$$S0(k) = \begin{Bmatrix} \text{PUNCH REACTION FORCE [Ton]} \\ \text{MOLD DISTORTION [}\mu\text{]} \end{Bmatrix} = \begin{Bmatrix} 500 \\ 900 \end{Bmatrix} \quad \text{(EXPRESSION 8)}$$

NOTE THAT $k = 1$ to 2

The forming condition calculation portion 104*f* may calculate the forming condition "C(i)" using Expression 2 above, and outputs the calculated firming condition "C(i)" to the control calculation unit 103*i* of the control device 103. The control calculation unit 103*i* can start the press-forming process based on this forming condition "C(i)".

The maximum value of the punch reaction force and the maximum value of the mold distortion during the forming can then be measured each time the press-forming process is performed, and the forming speed and the blank-holder pressure can be corrected in accordance with the difference between the measured maximum value of the punch reaction force and maximum value of the mold distortion, and the set standard values.

For example, when the measured value "S(k)" of the state quantity defined based on the maximum value of the punch reaction force and the maximum value of the mold distortion during the forming reaches the values shown in Expression 9 below, the forming condition calculation portion 104*f* can substitute the setting, value "C0'(i)" of the forming condition shown in Expression 7, the standard value "S0(k)" of the state quantity shown in Expression 8, and the influence function matrix "T2(i, k)" shown in Expression 10 below into Expression 2. A correction value "C(i)" of the forming condition can then be obtained as show in Expression 11 below. Incidentally, in the above description, the influence function matrix "T2(i, k)" can be set in advance.

[Formula 3]

$$S(k) = \begin{Bmatrix} \text{PUNCH REACTION FORCE [Ton]} \\ \text{MOLD DISTORTION } [\mu] \end{Bmatrix} = \begin{Bmatrix} 520 \\ 950 \end{Bmatrix} \quad \text{(EXPRESSION 9)}$$

$$T2(i, k) = \begin{bmatrix} 0.5 & 0.5 \\ -0.5 & -0.5 \end{bmatrix} \quad \text{(EXPRESSION 10)}$$

$$C(i) = \begin{Bmatrix} \text{FORMING SPEED [mm/sec]} \\ \text{BLANK-HOLDER PRESSURE [Ton]} \end{Bmatrix} = \begin{Bmatrix} 53.0 \\ 144.7 \end{Bmatrix} \quad \text{(EXPRESSION 11)}$$

As described above, the punch reaction force and the mold distortion during the press-process can be measured in addition to the material property data received from the material property data providing device 101, and the forming speed and the blank-holder pressure can be corrected in accordance with the measured results. Therefore, it becomes possible to determine improved forming conditions of the material to be processed 300, and to obtain a better-formed product.

As described above, the forming speed and the blank-holder pressure are corrected each time the press-forming process is performed. However, these values may be corrected after a number of press-forming processes have been performed. Further, the maximum value of the punch reaction force and the maximum value of the mold distortion during the press-forming process can be set equal to the standard value "S0(k)" of the state quantity, but the standard value "S0(k)" of the state quantity c be determined from a time-series of data of the punch reaction force and a time-series of data of the mold distortion during the press-forming process. For example, values of these parameters obtained at several points within the time-series of data may be used to evaluate the standard value "S0(k)" of the state quantity.

Additionally, the press-forming process can be performed without changing the forming speed and the blank-holder pressure as shown in Expression 11, but these values may be changed during the press-forming process in accordance, e.g., with a punch stroke.

Example 2

In a further exemplary embodiment of the present invention, the condition setting calculation device 104 can receive actual performance values of the tensile strength, the 0.2% proof stress, the total elongation, and the sheet thickness from the material property data providing device 101. Additionally, the condition-setting calculation device 104 can provide material property data which may not be provided by the material property data providing device 101, e.g., material property data which may not be known by an operator of the material property data providing device 101, based on an operation by a user of the operation portion provided at the condition setting calculation device 104. For example, a procedure can be provided in which an actual performance value of a lubricant film thickness is provided as an example of such material property data.

The forming condition calculation portion 104*f* can correct forming conditions such as, e.g., the forming speed and the blank-holder pressure by using Expression 1 based on the received material property data and the inputted material property data.

The forming conditions can be corrected, for example, by substituting the standard value "P0(j)" of the material properties shown in Expression 12 below, the influence function matrix "T1(i, j)" shown in Expression 13 below, and the actual performance value "P(j)" of the material properties defined from the above-stated material property data into Expression 1.

[Formula 4]

$$P0(i) = \begin{Bmatrix} \text{TENSILE STRENGTH [MPa]} \\ \text{0.2\% PROOF STRESS [MPa]} \\ \text{TOTAL ELONGATION [\%]} \\ \text{SHEET THICKNESS [mm]} \\ \text{LUBRICANT FILM THICKNESS } [\mu m] \end{Bmatrix} = \begin{Bmatrix} 604.8 \\ 399.8 \\ 23.6 \\ 1.4 \\ 10.0 \end{Bmatrix} \quad \text{(EXPRESSION 12)}$$

NOTE THAT $j = 1$ to 5

$$T1(i, j) = \begin{bmatrix} -0.5 & -0.5 & 0.5 & 0.5 & -0.5 \\ 0.5 & 0.5 & 0.5 & 0.5 & 0.5 \end{bmatrix} \quad \text{(EXPRESSION 13)}$$

As described above, the forming conditions can be corrected by considering the material property data which may be known only at the user side using the condition setting calculation device 104, in addition to the material property data received from the material property data providing device 101. Therefore, it may be possible to suppress an influence of variable factors such as a lubricity between the mold and the material to be processed 300 and a surface property, in addition to the variation of the material properties and the environmental changes which may be present. Accordingly, a more desirable forming condition can be obtained in such circumstances.

Example 3

In a further exemplary embodiment of the present invention, the condition setting calculation device 104 can again receive material property data in the form of actual performice values of the tensile strength, the 0.2% proof stress, the total elongation, and the sheet thickness from the material property data providing device 101. However, a representative value of a particular production lot (for example, the representative value of 100 sheets of materials to be processed 300) can also be received as material property data.

The condition setting calculation device 104 can provide material property data which may exhibit a large variation depending on the particular material to be processed 300, via the operation of the operation portion by the user provided at the condition setting calculation device 104. For example, an actual performance value of Vickers hardness of a particular material to be processed 300 can be provided as an example of such material property data.

The forming condition calculation portion 104*f* can correct the forming conditions such as e.g., the forming speed and the blank-holder pressure by applying Expression 1 based on the received material property data and the provided material property data.

For example, the standard value "P0(j)" of the material characteristics shown in Expression 14 below, the influence function matrix "T1(i, j)" shown in Expression 15 below, and the actual performance value "P(j)" of the material characteristics defined based on the above-cited material property data can be substituted into Expression 1 to set the forming conditions.

[Formula 5]

$$P0(j) = \begin{Bmatrix} \text{TENSILE STRENGTH [MPa]} \\ \text{0.2\% PROOF STRESS [MPa]} \\ \text{TOTAL ELONGATION [\%]} \\ \text{SHEET THICKNESS [mm]} \\ \text{VICKERS HARDNESS [Hv]} \end{Bmatrix} = \begin{Bmatrix} 604.8 \\ 399.8 \\ 23.6 \\ 1.4 \\ 175 \end{Bmatrix} \quad \text{(EXPRESSION 14)}$$

NOTE THAT $j = 1$ to 5

$$T1(i, j) = \begin{bmatrix} -0.5 & -0.5 & 0.5 & 0.5 & -0.5 \\ 0.5 & 0.5 & 0.5 & 0.5 & 0.5 \end{bmatrix} \quad \text{(EXPRESSION 15)}$$

As described above, the material property data, which can have a large effect on the press-forming process unless it is considered for each material to be processed 300, can be measured at the user side separately, and the forming conditions may be corrected using this the measured material property data. Therefore, it is possible to press-form the material adequately even if the material property data received from the material property data providing device 101 corresponds to a representative value of the particular production lot.

Example 4

In a still further exemplary embodiment of the present invention, the condition setting calculation device 104 can receive actual performance values of the tensile strength, the 0.2% proof stress, the total elongation, and the sheet thickness from the material property data providing device 101 to use as the material property data in addition, when the punch reaction force during the press-process exceeds a certain tolerance range, the blank-holder pressure can be adjusted so that the punch reaction force is within the tolerance range, and the press-process is continued with the adjusted bank-holder pressure.

For example, the standard value "P0(j)" of the material properties can be provided by Expression 16 below, the actual performance value "P(j)" of the material characteristics can be that shown in Expression 17, the standard value "C0(i)" of the forming conditions can be that shown in Expression 18, and the influence function matrix "T1(i, j)" can be that shown in Expression 19. These values can be substituted into Expression 1, and the correction value "C0'(i)" of the forming conditions in Expression 20 below can be obtained.

[Formula 6]

$$P0(j) = \begin{Bmatrix} \text{TENSILE STRENGTH [MPa]} \\ \text{0.2\% PROOF STRESS [MPa]} \\ \text{TOTAL ELONGATION [\%]} \\ \text{SHEET THICKNESS [mm]} \end{Bmatrix} = \begin{Bmatrix} 604.8 \\ 399.8 \\ 23.6 \\ 1.4 \end{Bmatrix} \quad \text{(EXPRESSION 16)}$$

NOTE THAT $j = 1$ to 4

$$P(j) = \begin{Bmatrix} 620 \\ 390 \\ 24 \\ 1.41 \end{Bmatrix} \quad \text{(EXPRESSION 17)}$$

$$C0(i) = \begin{Bmatrix} \text{FORMING SPEED [mm/sec]} \\ \text{BLANK-HOLDER PRESSURE [Ton]} \end{Bmatrix} = \begin{Bmatrix} 50.0 \\ 151.0 \end{Bmatrix} \quad \text{(EXPRESSION 18)}$$

NOTE THAT $i = 1$ to 2

$$T1(i, j) = \begin{bmatrix} -0.5 & -0.5 & 0.5 & 0.5 \\ 0.5 & 0.5 & 0.5 & 0.5 \end{bmatrix} \quad \text{(EXPRESSION 19)}$$

$$C0'(i) = \begin{Bmatrix} \text{FORMING SPEED [mm/sec]} \\ \text{BLANK-HOLDER PRESSURE [Ton]} \end{Bmatrix} = \begin{Bmatrix} 50.6 \\ 151.10 \end{Bmatrix} \quad \text{(EXPRESSION 20)}$$

The press-forming process can be started in accordance with the correction value "C0'(i)" of the forming conditions. After the press-forming process is started, the punch reaction force during the press-process can be measured by using the punch reaction force measuring unit **103*e* as described above, and the maximum value of the measured punch reaction three can be stored in a recording medium provided at the condition setting calculation device 104** each time the press-forming process is performed.

The forming condition calculation portion **104*f* of the condition setting calculation device 104** can determine whether a moving average value, e.g., of 10 points of the punch reaction forces stored in the recording medium is within a pre-set tolerance range. When it is not within the tolerance range, the blank-holder pressure can be adjusted as described above, and the press-process is continued.

Figure 7:
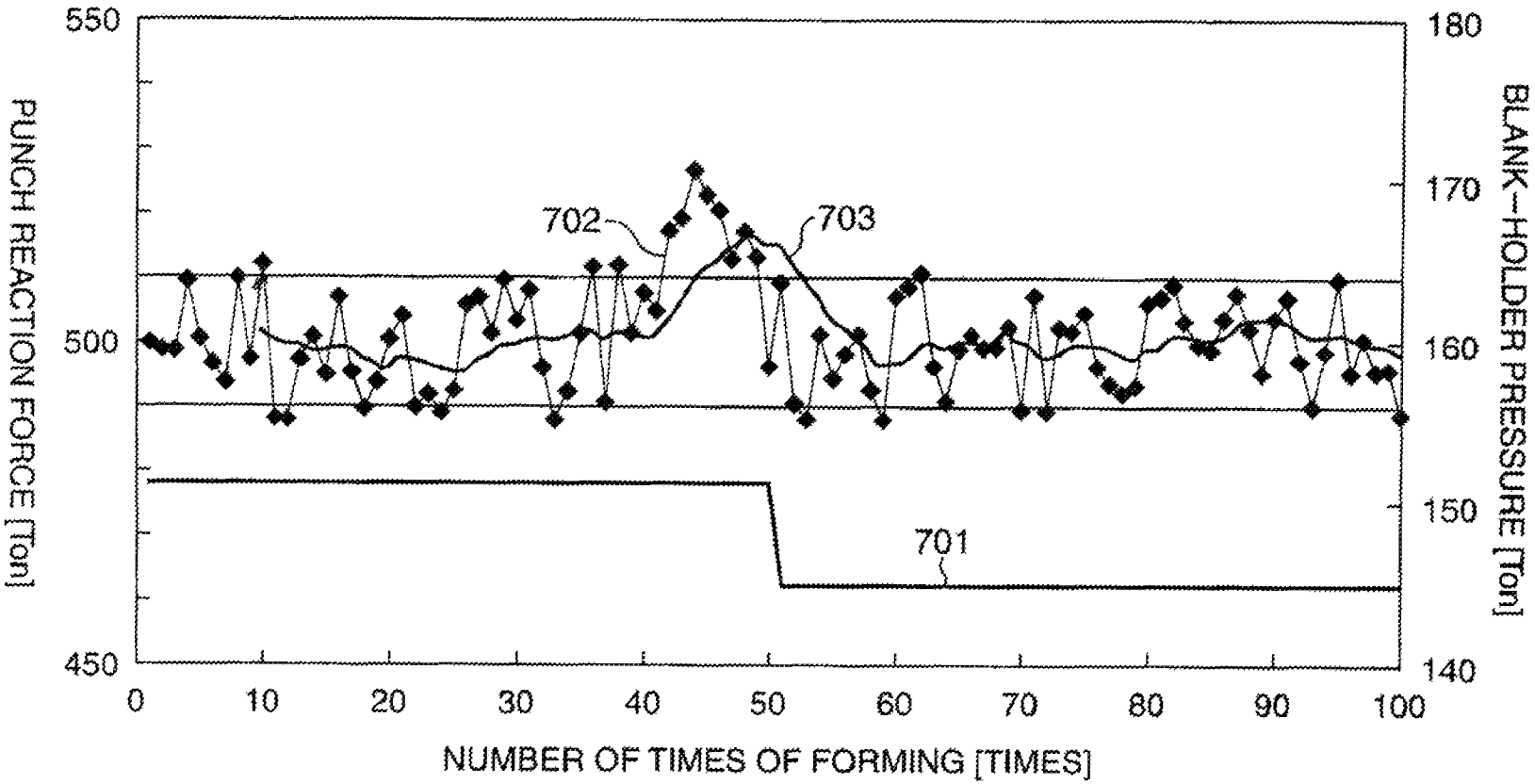
FIG. 7 is a schematic diagram of an exemplary relationship which can be provided between a measured value of a punch reaction force, a moving average of ten measured values of the punch reaction force, a blank-holder pressure, and a number of press-forming processes performed.

In the exemplary data shown in FIG. 7, a moving average 703 of 10 points of a measured value 702 of the punch reaction force is shown to exceed the tolerance range (e.g., between 490 Ton and 510 Ton) after the press-forming processes are performed for approximately 50 times. Accordingly, a blank-holder pressure 701 can be reduced from 150 Ton to 145 Ton, and the press-forming process is continued to generate a moving average 703 of the points of the measured values 702 of the punch reaction three that is within the tolerance range.

For example, when the measured value "S(k)" of the state quantity defined from the maximum value of the punch reaction force reaches a value shown in Expression 21 below, the correction value "C0'(i)" of the forming conditions shown in Expression 20, the influence function matrix "T2(i, k)" shown in Expression 22 below, and the standard value "S0(k)" of the state quantity in Expression 23, may each be substituted into Expression 1 and the correction value "C(i)" of the forming conditions shown in Expression 24 can be obtained. In this exemplary procedure, the influence function matrix "T2(i, k)" can be set in advance.

[Formula 7]

$$S(k) = \{520\} \quad \text{(EXPRESSION 21)}$$

$$T2(i, k) = [-0.5] \quad \text{(EXPRESSION 22)}$$

NOTE THAT $k = 1$ $$S0(k) = \begin{Bmatrix} \text{PUNCH REACTION FORCE (Ton)} \\ \text{MOLD DISTORTION } [\mu] \end{Bmatrix} = \begin{Bmatrix} 500 \\ 901 \end{Bmatrix} \quad \text{(EXPRESSION 23)}$$

$$C(i) = \begin{Bmatrix} \text{FORMING SPEED [mm/sec]} \\ \text{BLANK-HOLDER PRESSURE [Ton]} \end{Bmatrix} \begin{Bmatrix} 53.0 \\ 144.8 \end{Bmatrix} \quad \text{(EXPRESSION 24)}$$

NOTE THAT $i = 1$ to 2

As described above, the blank-holder pressure can be adjusted so that the punch reaction force returns to a value within the tolerance range when the punch reaction force during the press-forming process exceeds the tolerance range. Therefore, it may be possible to further reduce the occurrence of defective products, and to press-form a predetermined number of materials to be processed 300 in an improved manner.

The present example describes an exemplar process in which the blank-holder pressure is adjusted so that the punch reaction force remains within the tolerance range, and the press-forming process is continued using the adjusted blank-holder pressure. However, any one or more of the blank holder pressure, the forming speed, or the mold temperature may be adjusted in this manner such that the state quantity exceeding, the tolerance range returns to a value within the tolerance range, when the state quantity of e.g., the punch reaction force, the mold temperature, the mold distortion amount, the deformation amount of the material to be processed 300, and/or the temperature of the material to be processed 300 exceeds a tolerance range during the press-forming process.

Additionally, a current value and an actual previous performance value of the state quantity such as the punch reaction force can be compared, and process conditions such as the blank-holder pressure may be adjusted in accordance with the compared result. For example, when a difference between the current value and the actual previous performance value of the state quantity such as, e.g. the punch reaction force exceeds a predetermined value, the blank-holder pressure can be adjusted so that the resulting difference does not exceed the predetermined nod value.

Further, the moving average value of, e.g., 10 points of the state quantity of the punch reaction force can be evaluated as being within the pre-set tolerance range or not, but the moving average value of the state quantity within a predetermined time may be evaluated as being within the pre-set tolerance range or not.

Example 5

In a yet further exemplary embodiment of the present invention, the condition setting calculation device 104 can receive actual performance values of the tensile strength, the 0.2% proof stress, the total elongation, and the sheet thickness from the material property data providing device 101 as the material property data. However, the received material property data can be encrypted by the material property data providing device 101, and the press-forming can be performed using a procedure such as that described in Example 1 above after the material property data is decrypted by the condition setting calculation device 104. At this time, the material property data providing device 101 can be managed by a material manufacturer, and a transmission history file (containing, e.g., client name, connection date and time, amount of transmission data, and so on) may be updated each time the material property data is transmitted to a customer using the condition setting calculation device 104. The transmission history file can be periodically aggregated to generate a bill in accordance with a total communication amount. Accordingly, it is possible for the customer to obtain accurate material property data for each material processed while maintaining confidentiality of the data. Therefore, it is not necessary for the operator to experientially correct the thrilling conditions each time, and quality variation of the formed products may be reduced. Additionally, efforts needed to prepare a conventional paper-based mil sheet may be drastically reduced for the material manufacturer by the encryption and billing techniques described herein. Further, prevention of unauthorized copying and/or re-use of the material property data can be achieved, which can assist in covering administrative and/or maintenance expenses for this system while securing the confidentiality of the material property data.

Other Exemplary Embodiments of the Present Invention

Exemplary embodiments of the present invention also include, for example, computer program codes (e.g., in the form of software arrangements), where such program codes may be provided to configure, e.g., a computer or other processing arrangement associated with a piece of equipment or a system connected to various devices so as to at least in part control or operate the various devices in accordance with the various exemplary embodiments described herein. Such program codes may be provided in a form of any computer-accessible medium, e.g., a flexible disk, a hard disk, an optical disk, a magnetic optical disk, a CD-ROM, a magnetic tape, a non-volatile memory card, a ROM, and so on.

Such program codes, which may be operable in conjunction with an operating, system, other application software, or the like through a computer or other processing arrangement to thereby realize the functions of the exemplary embodiments described herein, are also considered to be within the scope of the present invention. These program codes and/or software arrangements may also be stored, e.g., in a memory included in a function expansion board of a computer or a function expansion unit connected to the computer, and a CPU or other processing arrangement may be further included in the function expansion board or the function expansion unit to perform a part or all of the actual processes based on instructions provided by the program codes, such that the functions of the exemplary embodiments can be realized by the processes.

INDUSTRIAL APPLICABILITY

According to exemplary embodiments of the present invention, a material may be press-formed using process conditions based on material property data transmitted from a server-side computer to a user-side computer via a network. In this manner, it may be possible to define forming conditions which can account for variations of the material properties. Accordingly, improved forming conditions may be determined, and more reliable and higher-quality formed products can be obtained.

The foregoing merely illustrates the principles of the invention. Various modifications and alterations to the described embodiments will be apparent to those skilled in the art in view of the teachings herein. It will thus be appreciated that those skilled in the art will be able to devise numerous systems, arrangements, media and methods which, although not explicitly shown or described herein, embody the principles of the invention and are thus within the spirit and scope of the present invention. In addition, all publications referenced herein above are incorporated herein by reference in their entireties.

What is claimed is:

1. A press-forming method, comprising:

providing at least one identifier associated with at least one material to be press-formed using a first processing arrangement;

transmitting the at least one identifier from the first processing arrangement to a second processing arrangement via a network;

transmitting at least one first material property stored in a database using the second processing arrangement, wherein the at least one first material property is associated with the at least one identifier;

receiving, at the first processing arrangement, the at least one first material property; and press-forming the at least one material using a process condition which is based on the at least one first material property, wherein the at least one identifier includes a production lot number, and wherein the second processing arrangement includes a first hardware arrangement associated with a manufacturer of the at least one material and the first processing arrangement includes a second hardware arrangement associated with a customer of the manufacturer.

2. The method of claim 1, further comprising determining the process condition based on the at least one material property using a calculation arrangement.

3. The method of claim 2, further comprising controlling at least one of a speed of the punch, a speed of the die, a mold temperature, or a blank-holder force based on the at least one process condition using a control arrangement.

4. The method of claim 3, further comprising determining at least one of the speed of the punch, the speed of the die, the mold temperature, or the blank-holder force based on a first information using the calculation arrangement when the at least one material is press-formed, wherein the first information comprises at least one of a punch reaction force, the mold temperature, a mold distortion, a deformation of the material, or a temperature of the at least one material, and the at least one material property.

5. The method of claim 4, further comprising measuring the first information using a measurement arrangement, wherein the at least one process condition is determined based on the first information measured by the measuring arrangement and based on the at least one first material property received by the first property receiving arrangement.

6. The method of claim 5, further comprising determining at least one of the speed of the punch, the speed of the die, the mold temperature, or the blank-holder force such that the first information assumes a value within a tolerance range when the first information measured by the measuring arrangement lies outside of the tolerance range using the calculation arrangement.

7. The method of claim 6, further comprising:

storing the first information using a storage arrangement, and determining a moving average value of the first information at least one of within a particular time interval or at a particular number of times based on the first information, and is still further configured to determine at least one of the speed of the punch, the speed of the die, the mold temperature, or the blank-holder force such that the moving average value is within the tolerance range using the calculation arrangement.

8. The method of claim 5, further comprising:

storing the first information using a storage arrangement, and comparing a current value of the first information measured by the measuring arrangement with a previous value of the first information stored in the storage arrangement, and is further configured to determine at least one of the speed of the punch, the speed of the die, the mold temperature, or the blank-holder force based on the comparison using the calculation arrangement.

9. The method of claim 2, further comprising:

receiving at least one second material property that is different from the at least one first material property received by the property receiving arrangement using a second property receiving arrangement, and determining the at least one process condition based on the at least one second material property and based on the at least one first material property received by the property receiving arrangement using the calculation arrangement.

10. The method of claim 9, wherein the at least one second material property comprises data obtained before the at least one material is formed by the press-forming apparatus.

11. The method of claim 9, wherein the at least one first material property received by the property receiving arrangement is associated with a production lot which includes the at least one material, and wherein the at least one second material property provided by the second property receiving arrangement is associated with the at least one material.

12. The method of claim 1, wherein the at least one first material property comprises at least one of a sheet thickness, a yield stress, a 0.2% proof stress, a tensile strength, an elongation, an n-value, an r-value, a relational expression between a stress and a strain, a hardness, a temperature, a surface roughness, a friction coefficient, or a lubricant film thickness associated with the at least one material.

13. The method of claim 2, further comprising providing the at least one first material property to the calculation arrangement using a data transfer arrangement, and preventing access to the at least one first material property by a user when the at least one first material property is provided to the first processing arrangement using the data transfer arrangement.

14. The method of claim 1, further generating a bill based on a transmission of the at least one first material property to the first processing arrangement using a billing arrangement.

15. A press-forming method, comprising:

providing at least one identifier associated with at least one material to be press-formed using a first processing arrangement;

transmitting the at least one identifier from the first processing arrangement to a second processing arrangement via a network;

transmitting at least one first material property stored in a database using the second processing arrangement, wherein the at least one first material property is associated with the at least one identifier;

receiving, at the first processing arrangement, the at least one first material property;

providing the at least one first material property to the calculation arrangement using a data transfer arrangement;

preventing access to the at least one first material property by a user when the at least one first material property is provided to the calculation arrangement using the data transfer arrangement;

determining a process condition based on the at least one material property using a calculation arrangement; and press-forming the at least one material using the process condition.

16. A press-forming method, comprising:

providing at least one identifier associated with at least one material to be press-formed using a first processing arrangement;

transmitting the at least one identifier from the first processing arrangement to a second processing arrangement via a network;

transmitting at least one first material property stored in a database using the second processing arrangement, wherein the at least one first material property is associated with the at least one identifier;

receiving, at the first processing arrangement, the at least one first material property;

press-forming the at least one material using a process condition which is based on the at least one first material property; and generating a bill based on a transmission of the at least one first material property to the first processing arrangement using a billing arrangement.

17. A press-forming method, comprising:

providing at least one identifier associated with at least one material to be press-formed using a first processing arrangement;

transmitting the at least one identifier from the first processing arrangement to a second processing arrangement via a network;

transmitting at least one first material property stored in a database using the second processing arrangement, wherein the at least one first material property is associated with the at least one identifier;

receiving, at the first processing arrangement, the at least one first material property; and press-forming the at least one material using a process condition which is based on the at least one first material property, wherein the at least one identifier includes a production lot number, and wherein the first and second processing arrangements are disposed in locations remote from each other on the network.

18. The method of claim 17, wherein the first and second processing arrangements are hardware arrangements.

19. The method of claim 17, wherein the second processing arrangement includes a first hardware arrangement associated with a manufacturer of the at least one material and the first processing arrangement includes a second hardware arrangement associated with a customer of the manufacturer.

* * * * *